US006851668B2

(12) United States Patent
Mui et al.

(10) Patent No.: US 6,851,668 B2
(45) Date of Patent: Feb. 8, 2005

(54) MULTIPLE LOGICAL BINS ON A SINGLE OUTPUT TRAY WITH SHEET MEDIA LEVEL DETECTION SYSTEM

(75) Inventors: Paul K. Mui, Boise, ID (US); Gustavo Guillemin, Jalisco (MX); Roberto Obregon, Jalisco (MX); Russell A. Mendenhall, Boise, ID (US); David J. Arcaro, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 185 days.

(21) Appl. No.: 10/348,442

(22) Filed: Jan. 21, 2003

(65) Prior Publication Data

US 2004/0140608 A1 Jul. 22, 2004

(51) Int. Cl.[7] ..... B65H 5/22; B65H 83/00; B65H 85/00

(52) U.S. Cl. ..... 271/3.17; 271/365; 399/405; 162/269

(58) Field of Search ..... 271/3.17, 265; 399/405

(56) References Cited

U.S. PATENT DOCUMENTS 4,033,576 A 7/1977 Stanfield
4,905,055 A 2/1990 Higaki
5,823,529 A * 10/1998 Mandel et al. ..... 271/296
5,963,754 A * 10/1999 Itoh et al. ..... 399/21
6,142,469 A * 11/2000 Nanba et al. ..... 271/288
6,152,443 A * 11/2000 Claramunt et al. .... 271/258.05
6,275,664 B1 8/2001 Wolf et al.
6,308,952 B1 10/2001 Takagi et al.
6,408,147 B1 * 6/2002 Oshida ..... 399/82
6,443,449 B1 9/2002 Takagi et al.

FOREIGN PATENT DOCUMENTS

JP 4-133955 * 5/1992 ..... B65H/29/00

* cited by examiner

*Primary Examiner*—Donald P. Walsh
*Assistant Examiner*—Kenneth W. Bower

(57) ABSTRACT

A representative embodiment provides for a sheet media level detection system, including a first level detector configured to provide a first signal corresponding to a first predetermined level of a first sheet media from a first source within an output tray, and a second level detector configured to provide a second signal corresponding to a second predetermined level of a second sheet media from a second source within the output tray. Another embodiment provides for a method including routing a first sheet media and a second sheet media from respective sources into a common output tray, and issuing a first signal in response to detecting a first predetermined level of the first sheet media using a first level detector, and issuing a second signal in response to detecting a second predetermined level of the second sheet media in the output tray using a second level detector.

24 Claims, 7 Drawing Sheets

MULTIPLE LOGICAL BINS ON A SINGLE OUTPUT TRAY WITH SHEET MEDIA LEVEL DETECTION SYSTEM

BACKGROUND

The combining of an imaging device with a sheet handling device, thus forming a unitary imaging apparatus, is known. Typically, the imaging device is in the form of a printer or copier, or any other device that forms images on sheet media, such as paper. Furthermore, the sheet handling device that is typically combined (i.e., incorporated) with such an imaging device generally has one or more sheet handling functions, such as, for example, stapling, collating, sheet folding, or hole punching.

Some types of unitary imaging apparatus further include some other kind of device for use with sheet media, such as a scanner. One possible example of a unitary imaging apparatus can include a laser printer, a sheet handling device, and a copier/scanner incorporated as a single unit. Such unitary imaging apparatus are sometimes generally referred to as multifunction or all-in-one machines. Other examples of unitary imaging apparatus are possible.

While the relatively broad range of functions provided by a typical unitary imaging apparatus is generally desirable to some users, the size and orientation of features on such an apparatus can contribute to usage difficulties on the part of some persons. For example, when some particular unitary imaging apparatus is located on a desk or table top, within, say, an office or other multi-user environment, the reach required for a given person to access the uppermost features of the apparatus can make usage generally difficult or otherwise undesirable. In another exemplary situation, a given user can lack the physical stature to utilize some or all of the controls on a similarly located unitary imaging apparatus.

Therefore, it is desirable to provide a unitary imaging apparatus that avoids the usage difficulties described above.

SUMMARY

One embodiment provides for a sheet media level detection system including a first level detector configured to provide a first signal corresponding to a first predetermined level of a first sheet media from a first source within an output tray, and a second level detector configured to provide a second signal corresponding to a second predetermined level of a second sheet media from a second source within the output tray.

Another embodiment provides for a sheet media level detection system configured for use in conjunction with an imaging device and a sheet handling device common to a unitary imaging apparatus including a first level detector configured to provide a first signal to the imaging device, in response to detecting a first predetermined level of a first sheet media in an output tray, the first sheet media having passed through the imaging device prior to arriving in the output tray. The sheet media level detection system further includes a second level detector configured to provide a second signal to the sheet handling device in response to detecting a second predetermined level of a second sheet media in the output tray, the second sheet media having passed through the sheet handling device prior to arriving in the common output tray.

Yet another embodiment provides for an imaging apparatus, including an imaging device configured to generate an image on sheet media, and a sheet handling device configured to receive sheet media from the imaging device. The imaging apparatus also includes an output tray configured to receive sheet media frorn both of the imaging device and the sheet handling device. The imaging apparatus further includes a sheet media level detection system, the system including a first level detector configured to provide a first signal to the imaging device in correspondence to a first predetermined level of sheet media placed in the output tray by the imaging device, and a second level detector configured to provide a second signal to the sheet handling device in correspondence to a second predetermined level of sheet media placed in the output tray by the sheet handling device.

Still another embodiment provides a printer device including means for forming images on a first and a second sheet media, means for receiving the first and second sheet media, and means for selectively performing at least one sheet handling operation on the second sheet media and then discharging the second sheet media to the receiving means. The printer device also includes means for selectively diverting the first sheet media from the image forming means to the receiving means and the second sheet media from the image forming means to the sheet handling means. The printer device further includes means for providing a first signal in correspondence to a first predetermined level of the first sheet media in the receiving means, and means for providing a second signal in correspondence to a second predetermined level of the second sheet media in the receiving means.

Yet another embodiment provides for a method of detecting respective predetermined levels of a first sheet media and a second sheet media within a common output tray. The method includes routing the first sheet media from an imaging device into the output tray using a diverter device, and routing the second sheet media from the imaging device into a sheet handling device and then into the output tray using the diverter device. The method further includes issuing a first signal in response to detecting a first predetermined level of the first sheet media in the output tray using a first level detector, and issuing a second signal in response to detecting a second predetermined level of the second sheet media in the output tray using a second level detector.

These and other aspects and embodiments will now be described in detail with reference to the accompanying drawings, wherein:

DETAILED DESCRIPTION

In representative embodiments, the present teachings provide methods and apparatus for a unitary imaging apparatus that avoids the usage difficulties discussed above.

Figure 1:
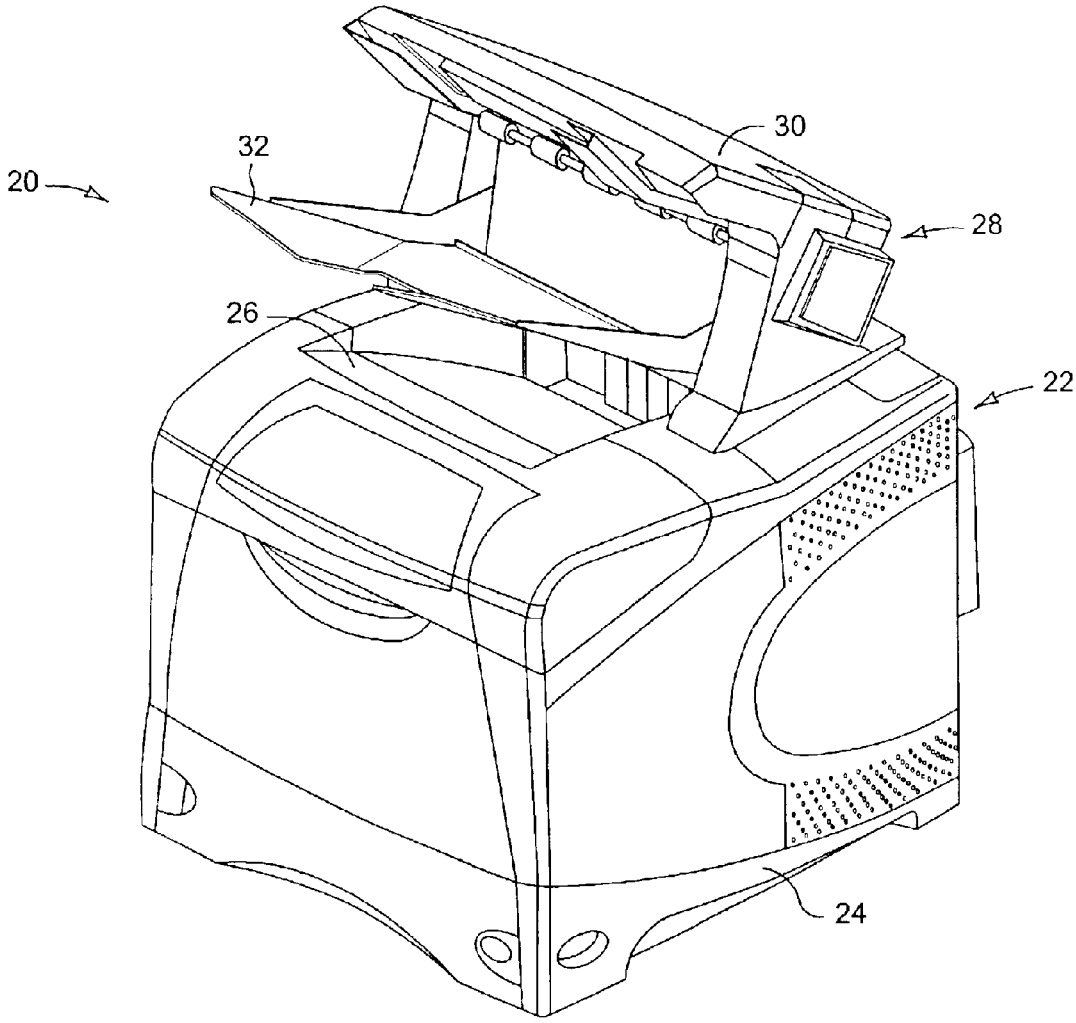
FIG. 1 (Prior Art)
FIG. 1 is a perspective view depicting a unitary imaging apparatus in accordance with one example of the prior art.

FIG. 1 is a perspective view depicting a unitary imaging apparatus 20 in accordance with the prior art. The unitary imaging apparatus 20 includes a printer 22. The printer 22 as shown is a laser printer, but other kinds of printer such as, for example, ink jet, thermal paper, or dot matrix can be used. The printer 22 includes a printer housing 24, which is configured to generally house and support a plurality of components (not shown) that are inherent to the printer 22. It can be appreciated by those of skill in the art that the components (not shown) inherent to the printer 22 are known and required for typical operation thereof, and that further elaboration of these components is not required for purposes herein.

The printer 22 of the imaging apparatus 20 further includes a printer output tray 26. The printer output tray 26 is supported by, and generally made integral with, the housing 24 of the printer 22. The printer output tray 26 is configured to receive sheet media (not shown) from the components (not shown) of the printer 22.

The unitary imaging apparatus 20 further includes a sheet handling device 28. The sheet handling device 28 includes a handler housing 30, which is configured to generally house and support a plurality of other components (not shown), which are inherent to the sheet handling device 28. For example, such sheet handling components (not shown) can include, but are not limited to, a stapler, a collator, a folder, or a hole punch. Other kinds of components for use with the sheet handling device 28 are possible. The sheet handling device 28 further includes a handler output tray 32 that is supported by the handler housing 30 and configured to receive sheet media (not shown) from the components (not shown) of the sheet handling device 28.

Operation of the unitary imaging device 20 is generally conducted as follows: The printer 22 receives print job data representing an imaging task (i.e., a document or documents to be printed and optionally handled) by way of a user computer (not shown) coupled to the unitary imaging device 20. The printer 22 forms images on sheet media (not shown) corresponding to the data, and selectively transports the printed sheet media (not shown) into the printer output tray 26, or into the sheet handling device 28, in accordance with the print job data.

In a case in which the print job data does not call for any post-imaging operations to be performed by the sheet handling device 28, the printer 22 simply discharges the printed sheet media (not shown) directly to the printer output tray 26.

In another case, in which the print job data received by the printer 22 does request one or more post-imaging operations to be performed by the sheet handling device 28 (such as, for example, stapling individual sheet media together as a single document), the printer 22 transports and guides the printed sheet media (not shown) into the sheet handling device 28, where the data-requested sheet handling operations (e.g., stapling) are performed. Upon completion of the sheet handling operation or operations, the sheet handling device 28 discharges the printed and handled sheet media (not shown) into the handler output tray 32.

The unitary imaging apparatus 20 is typically located for operation on a desk or counter top (not shown). As such, a user is required to have sufficient reach so as to retrieve sheet media from either or both of the printer output tray 26 and the handler output tray 32, in accordance with the situation at hand. For some persons, this reach requirement is not readily attained, particularly in the case of accessing the handler output tray 32, to the extent that some individuals must resort to using a stepstool or other assistance so as to retrieve sheet media there from. The situation is exacerbated for persons in wheelchairs or having mobility handicaps.

Figure 2:
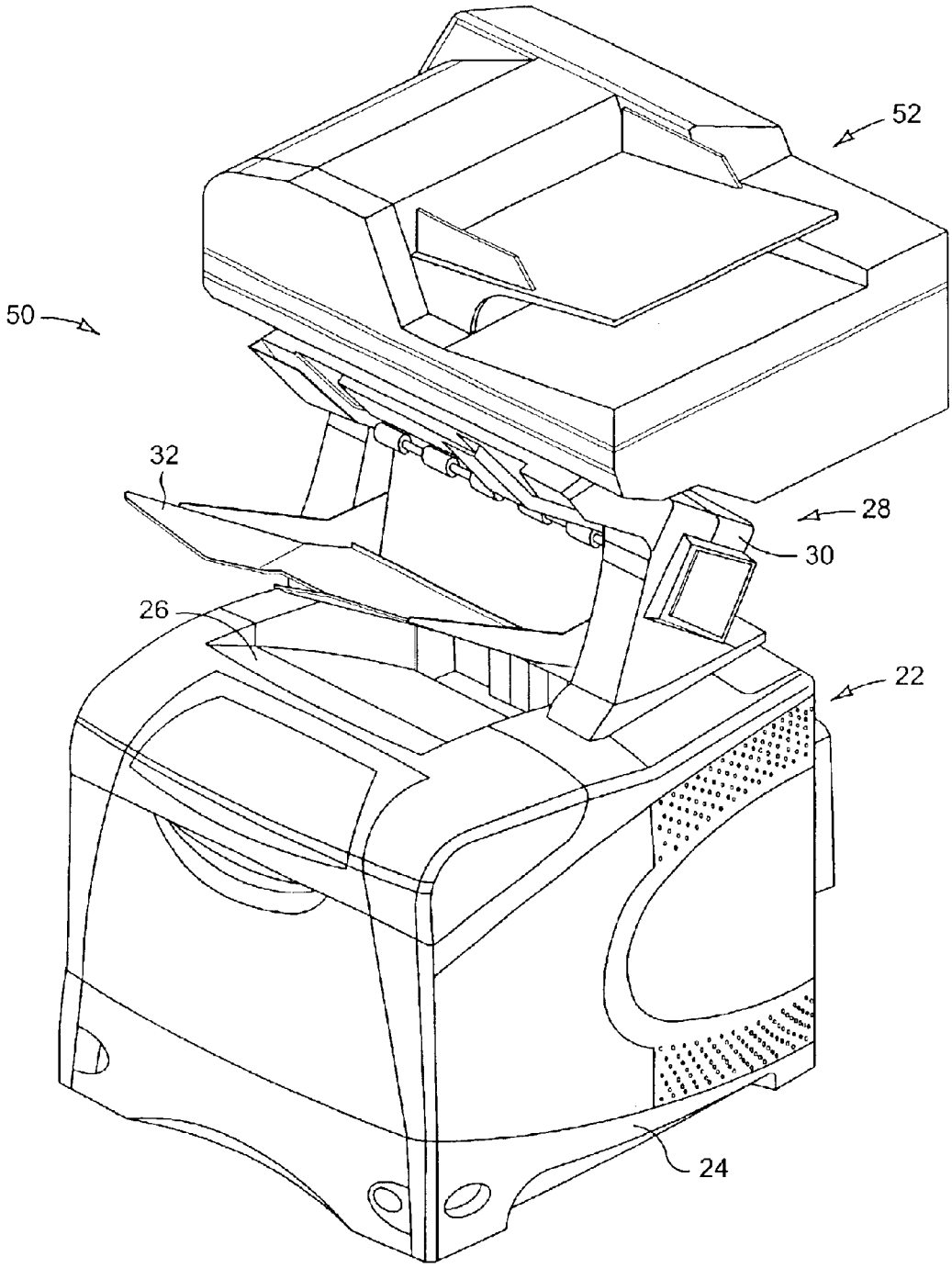
FIG. 2 (Prior Art)
FIG. 2 is a perspective view depicting a unitary imaging apparatus in accordance with another example of the prior art.

FIG. 2 is a perspective view depicting a unitary imaging apparatus 50 in accordance with another example of the prior art. The unitary imaging device 50 includes a printer 22, printer housing 24, printer output tray 26, sheet handling device 28, handler housing 30, and a handler output tray 32 which retain substantially all of the elements, features and cooperative performance described above for the like numbered elements of the unitary imaging device 20 of FIG. 1. The unitary imaging apparatus 50 further includes a scanner 52. The scanner 52 is generally coupled to and supported by the housing 24 of the printer 22, by way of the housing 30 of the sheet handling device 28.

Operation of the unitary imaging apparatus 50 is performed substantially as described above for the unitary imaging apparatus 20. Additionally, the scanner 52 of the apparatus 50 can be used to derive scanned data representing the image content of scanned sheet media (not shown). This scanned data can then be used for other imaging purposes, such as, for example, producing copies of the scanned sheet media using the printer 22, incorporating the scanned data within a document file stored in a computer (not shown) coupled to the imaging apparatus 50, etc.

Certain typical operations of the unitary imaging apparatus 50 require a user to, for example, place sheet media (not shown) on, or remove sheet media from, the scanner 52. The execution of these and other operations further require that a user possess, or otherwise exercise, sufficient reach to access the scanner 52. As the scanner 52 is located generally over the sheet handling device 28, and away from the customary side of approach to the unitary imaging apparatus 50, the reach required in using the scanner 52 can be undesirably burdensome, or nearly impossible, for some persons to achieve. Furthermore, the required reach to the scanner 52 or other aspects of the unitary imaging apparatus 50 (such as, for example, the handler output tray 32) can be made even more troublesome as a result of the location of use, or other factors.

Therefore, it is desirable to provide a unitary imaging apparatus that avoids the undesirable reach and access problems described above. Embodiments of the present invention provide for respective unitary imaging apparatuses that include a single media output tray, which is configured to receive sheet media discharged from two different sources such as, for example, a printer and a sheet handling device. Through the use of a single media output tray, and two media level detectors respectively associated with the two different sources that discharge sheet media into the output tray, embodiments of the present invention are generally reduced in overall physical size, relative to typical unitary imaging apparatuses of the prior art, thereby reducing the reach requirement imposed upon a user during typical operation. Such embodiments of the present invention are described hereafter.

Figure 3:
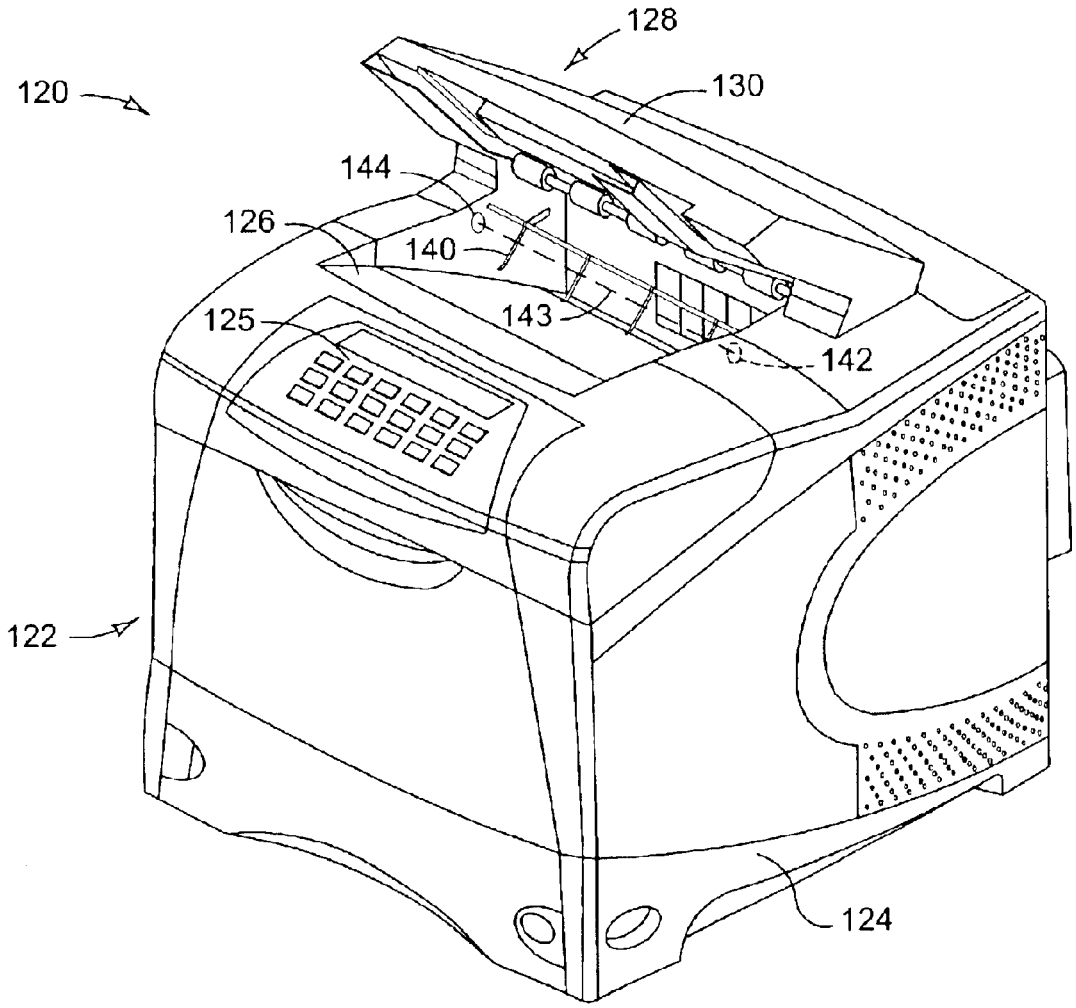
FIG. 3 is a perspective view depicting a unitary imaging apparatus in accordance with one embodiment of the present invention.

FIG. 3 is a perspective view depicting a unitary imaging apparatus 120 in accordance with an embodiment of the present invention. The unitary imaging apparatus 120 includes a printer 122. As shown, the printer 122 is a laser printer; however, it is to be understood that any suitable printer can be used, such as, for example, an ink jet printer, a thermal-paper printer, a dot matrix printer, etc. Generally, most kinds of printer can be used within the scope of the invention. The printer 122 is configured to form images on sheet media (not shown), in accordance with data received (typically) from a computer (not shown) coupled to the unitary imaging apparatus 120.

The printer 122 includes a housing 124. The housing 124 is configured to house and support a plurality of printer components inherent to the printer 122. A portion of these components shall be described in detail hereafter, as required for an understanding of the invention. The printer 122 further includes an output tray 126. The output tray 126 is supported by, and generally made integral with, the housing 124 of the printer 122. The output tray 126 is configured to receive sheet media (not shown) from the printer 122 and a sheet handling device 128, described hereafter. The printer 122 further includes a user interface (i.e., control panel) 125, supported by the housing 124. The control panel 125 is configured to provide various status indications to, and to accept operating instructions from, a user in accordance with typical operation of the unitary imaging apparatus 120.

The unitary imaging apparatus 120 further includes a sheet handling device 128. The sheet handling device 128 includes a handler housing 130. The handler housing 130 is configured to house and support a plurality of handler components (not shown in FIG. 3) inherent to the sheet handling device 128. Non-limiting examples of such handler components can include a stapler, a collator, a folder, a binder, or a hole punch. Other handler components can be used in conjunction with the sheet handling device 128. The sheet handling device 128 is support by the printer housing 124, and is generally disposed in overlying adjacency to the output tray 126. The sheet handling device 128 is configured to receive printed sheet media (not shown) from the printer 122, to perform one or more handling operations on the received sheet media, and to discharge the handled sheet media to the output tray 126.

The printer 122 of the imaging apparatus 120 further includes a feeler lever 140, a second light source 142, and a second light sensor 144, which are supported by the printer housing 124. The feeler lever 140, second light source 142 and second light sensor will be described hereafter in conjunction with other elements and the operation of the imaging apparatus 120, and are noted here for purposes of understanding their respective orientations within the imaging apparatus 120.

Figure 4:
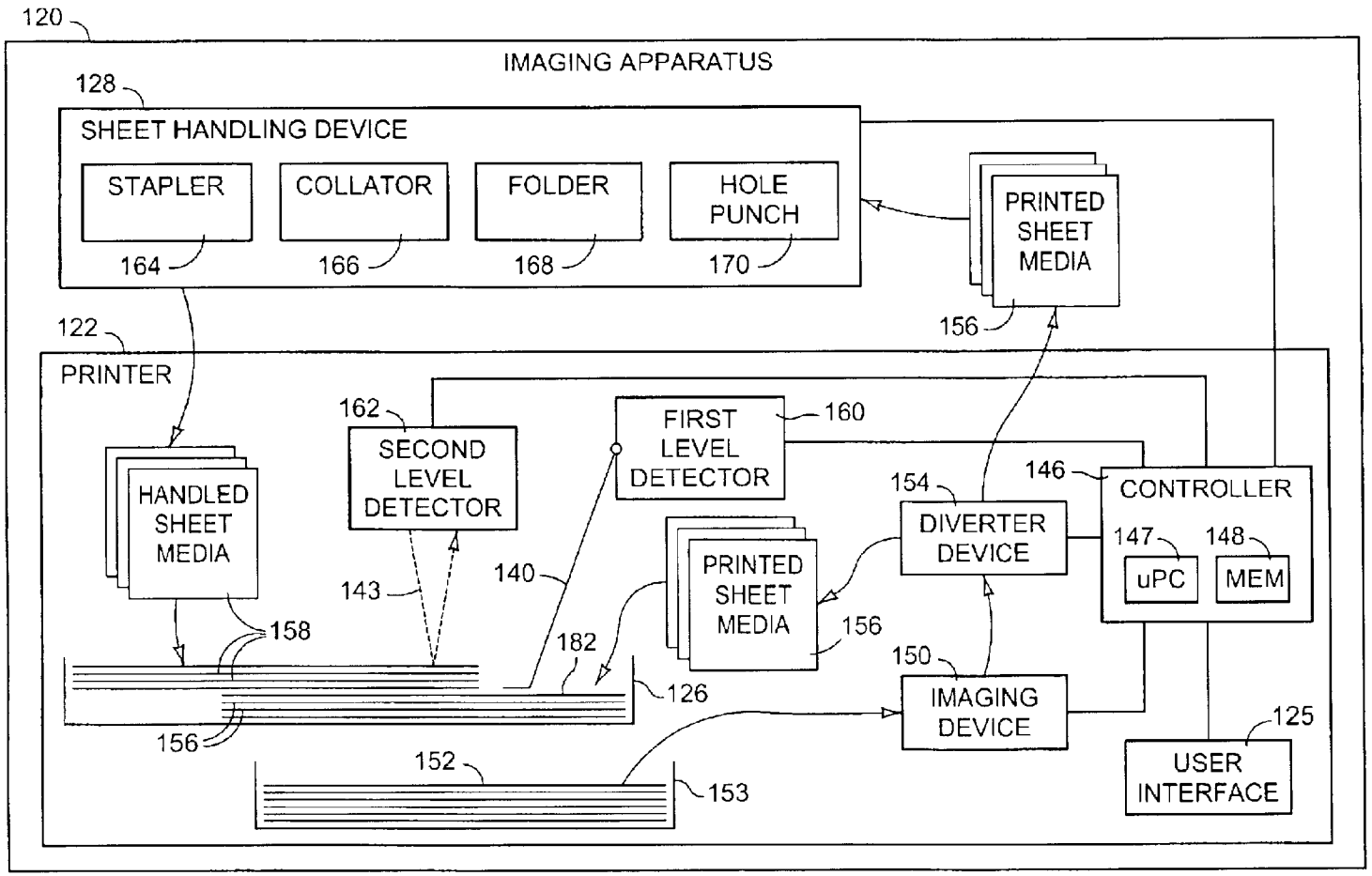
FIG. 4 is a block diagrammatic view depicting typical cooperative elements in accordance with the embodiment of FIG. 3.

FIG. 4 is a block diagrammatic view depicting a cooperative arrangement of elements typical to the unitary imaging apparatus 120 of FIG. 3. The unitary imaging apparatus 120 includes a controller 146 within the printer 122. As shown, the controller 146 includes a microprocessor 147 and a computer-readable memory 148. Other forms of controller in accordance with other embodiments of imaging apparatus 120 are also possible. The controller 146 is configured to control various normal operations of the unitary imaging apparatus 120, described in detail hereafter.

The unitary imaging apparatus 120 also includes the user interface 125, which is in signal communication with the controller 146. The user interface 125 can provide indications to a user (e.g., audible alert and/or visual signals), as well as accept user instructions regarding operations of the unitary imaging apparatus 120. Non-limiting examples of such audible and/or visual user indications can include indications of paper-jam, full tray, empty sheet media tray or other resource, etc. Non-limiting examples of user instructions can includes number-of-copies, sheet media source selection, sheet handling, resume normal operation after suspended operation, etc.

The printer 122 further includes an imaging device 150, which is in signal communication with the controller 146 and configured to form images on (typically) blank sheet media 152, thus producing printed sheet media 156. It is to be understood that the imaging apparatus 120 includes components that provide the imaging apparatus 120 with the ability to transport and route sheet media 152 and 156 within the printer 122 and the sheet handling device 128 as required for normal operation, as will be well understood by one of skill in the art. The printer 122 further includes a diverter device 154. The diverter device 154 is in signal communication with the controller 146 and is configured to receive the printed sheet media 156 from the imaging device 150. The diverter device 154 is further configured to selectively route the printed sheet media 156 to the output tray 126, or to route the printed sheet media 156 to the sheet handling device 128 of the unitary imaging device 120, under the control of the controller 146.

The printer 122 further includes a first level detector 160, which is in signal communication with the controller 146. The first level detector is configured to detect a first predetermined level of the printed sheet media 156 in the output tray 126, via the feeler lever 140, and to provide a signal to the controller 146 corresponding to the detection. The printer 122 also includes a second level detector 162 that is coupled to the controller 146. The second level detector 162 is configured to detect a second predetermined level of a handled sheet media 158 (described hereafter) within the output tray 126, and to provide a signal to the controller 146 corresponding to the detection.

The sheet handling device 128 of the unitary imaging apparatus 120 is in signal communication with the controller 146, and is controlled thereby. The sheet handling device 128 can include one or more of a stapler 164, a collator 166, a folder 168, and a hole punch 170. Other functional devices in accordance with other embodiments of sheet handling device (not shown) can also be provided. The sheet handling device 128 is configured to receive the printed sheet media 156 from the diverter 154, to perform one or more operations on the sheet media 156, using one or more of the devices 164–170, resulting in a handled sheet media 158. The sheet handling device 128 is further configured to discharge the handled sheet media 158 into the output tray 126 of the printer 122.

In normal operation, the unitary imaging apparatus 120 performs as follows: The unitary imaging apparatus 120 receives print job data from a computer (not shown) or another source that is in signal communication with the controller 146 of the printer 122. The imaging apparatus 120 draws (typically) blank sheet media 152 from a holding tray 153 and routes it to the imaging device 150. The imaging device 150 forms images (i.e., prints indicia) on the sheet media 152 in correspondence to the received print job data, resulting in the printed sheet media 156. The printed sheet media 156 is then routed from the imaging device 150 to the diverter device 154.

The diverter device 154 then routes the printed sheet media 156 to one of the output tray 126, or to the sheet handling device 128, in accordance with the print job data received by the controller 146. If the print job data does not require any operations to be performed by the sheet handling device 128, then the printed sheet media 156 is routed to (i.e., accumulates within) the output tray 126. If, however, the print job data calls for one or more sheet handling operations to be performed on the printed media 156 (i.e., stapling, hole punching, etc.), the printed sheet media 156 is routed to the sheet handling device 128 via corresponding passageways and mechanisms (not shown).

Assuming that the print job data does call for sheet handling, the sheet handling device 128 receives the printed sheet media 156 from the diverter 154. The sheet handling device 128 then performs one or more handling operations on the printed sheet media 156 in accordance with the print job data, using the stapler 164, collator 166, folder 168, and/or hole punch 170 as needed. The resulting handled sheet media 158 is then discharged into the output tray 126 by the sheet handling device 128.

It is noted that the imaging apparatus 120 makes use of the single output tray 126 to receive both the printed sheet media 156 and the handled sheet media 158. In this way, the sheet handling device 128 does not include an associated (i.e., handler) output tray, in contrast to the handler output tray 32 of the imaging apparatus 20 of FIG. 1. Therefore, an operator need only have sufficient reach to access the output tray 126 of the unitary imaging apparatus 120, to carry out normally associated operations.

The unitary imaging apparatus 120 further provides for a generally more compact housing arrangement (i.e., combined size of the housings 124 and 130 of FIG. 3), thus enabling the imaging apparatus 120 to support another sheet media manipulation device, such as, for example, a scanner (not shown, but similar to scanner 52 of FIG. 2), with a reduction in the required user reach relative to that associated with the prior art described above.

Figure 5:
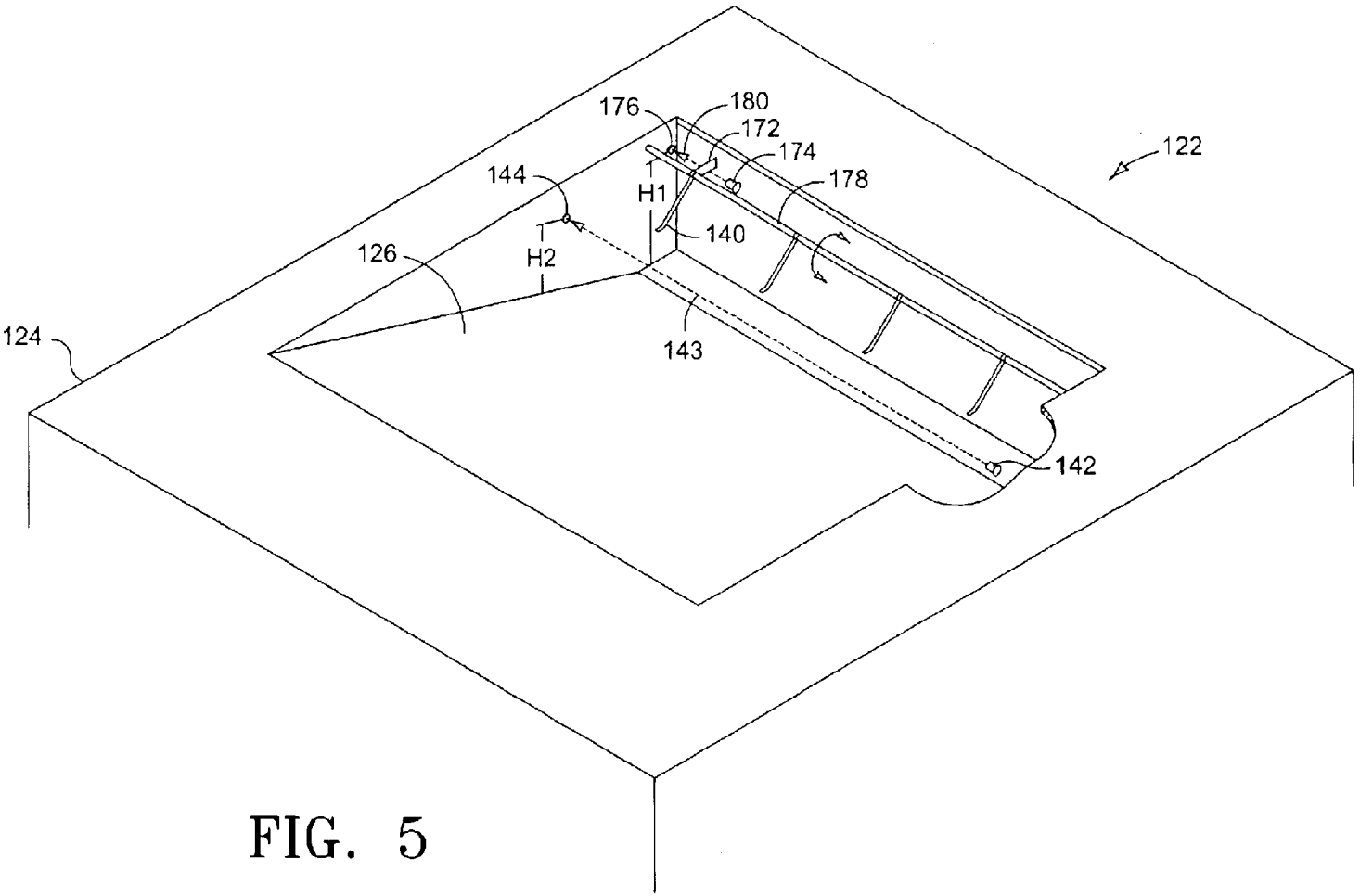
FIG. 5 is a perspective cutaway view depicting selected elements in accordance with the embodiment of FIG. 3.

FIG. 5 is perspective cutaway view of selected elements of the printer 122 of the unitary imaging apparatus 120. The printer 122 includes the feeler lever 140, as introduced above. The feeler lever 140 is rotatably supported by a shaft 178, which in turn is supported by the printer housing 124. The printer 122 further includes a first light source 174 and a first light sensor 176, each supported by the housing 124 in generally close proximity to the feeler lever 140. The first light source 174 and the first light sensor 176 are both elements common to the first level detector 160, described above. The first light source 174 emits a first light beam 180 to the first light sensor 176. Furthermore, the first light source 174 and the first light sensor 176 are supported at a height H1, which generally defines a predetermined "full" level for the printed sheet media 156 (not shown in FIG. 5) within the output tray 126.

The printer 122 further includes the second light source 142 and the second light sensor 144, as introduced above. The second light source 142 and second light sensor 144 are supported by the printer housing 124, in cooperative relation to each other on opposite sides of the output tray 126. The second light source 142 and second light sensor 144 are both elements common to the second level detector 162, described above. The second light source 142 is configured to emit a second light beam 143 to the second light sensor 144 that generally spans the width of the output tray 126. Furthermore, the second light source 142 and the second light sensor 144 are supported at a common height H2, which generally defines a predetermined "full" level for the handled sheet media 158 (not shown in FIG. 5) within the output tray 126.

Concurrent reference is now made to FIGS. 4 and 5. During the typical operation of the unitary imaging apparatus 120, the printed sheet media 156 passes generally under, and typically in brief contact with, the feeler lever 140 while in route to the output tray 126. The printed sheet media 156 generally accumulates beneath the feeler lever 140 within the output tray 126. If the level, or quantity, of the printed sheet media 156 increases to a certain point within the output tray 126, the feeler lever 140 will maintain substantially continuous contact with a top sheet 182 of the printed sheet media 156. It is noted that the particular top sheet 182 is successively replaced with the most recently arrived printed sheet 156. The feeler lever 140 rotates incrementally about the support shaft 178 in correspondence to the accumulation of the printed sheet media 156 within the output tray 126.

If the level of the printed sheet media 156 increases to the associated predetermined "full" level (i.e., as defined by height H1) within the output tray 126, an extension flag 172 of the feeler lever 140 moves to such a position as to substantially (i.e., detectably) block the first light beam 180 from reaching the first light sensor 176. The first level detector 160 responds to the blockage of the first light beam 180 by providing a first "full" signal to the controller 146.

The controller 146 can then take one or more predetermined actions in response to the first signal, such as, for example, temporarily (i.e., resetably, or resumably) suspending the normal operation of the imaging device 150, until such time as the predetermined level of printed sheet media 156 is cleared (i.e., removed) from the output tray 126, and/or a resume instruction is received via the user interface 125. Other actions on the part of the controller 146 can also be provided, such as providing an audio and/or visual alert to an operator regarding the full condition of the output tray 126, via the user interface 125 or other suitable means.

Under such a cleared condition of the output tray 126, the feeler lever 140 returns to a normal operating position, and the first level detector 160 removes or otherwise negates the first full signal sent to the controller 146, and normal operation of the imaging device 150 is typically resumed by the controller 146.

Also during typical operation, the handled sheet media 158 arrives in the output tray 126 generally from above the feeler lever 140, usually coming to rest on top of the feeler lever 140. Therefore, the feeler lever 140 and other associated elements of the first level detector 160 are generally unusable in determining the level (i.e., "full" level) of the handled sheet media 158 within the output tray 126. Rather, if the handled sheet media 158 accumulates in the output tray 126 to the extent that the predetermined "full" level defined by the height H2 is reached, then the second light beam 143 is substantially obscured, or blocked, from reaching the second light sensor 144. The second level detector 162 responds to the blockage of the second light beam 143 by providing a second "full" signal to the controller 146.

The controller 146 can then take one or more predetermined actions, such as, for example, temporarily (i.e., resumably) suspending the normal operation of the sheet handling device 128, until such time as the predetermined level of handled sheet media 158 is cleared (i.e., removed) from the output tray 126. Other actions on the part of the controller 146 are also possible, such as providing an audio and/or visual alert to an operator regarding the full condition of the output tray 126. Other actions on the part of the controller 146 can also be provided, such as providing operator alert indications regarding the "full" state of the output tray 126.

Once the output tray 126 is returned to a cleared condition, typically by the removal of the handled sheet media 158 resting therein, the second light beam 143 is again detected by the second sensor 144. In response, the second level detector 162 removes or otherwise negates the second full signal sent to the controller 146, and normal operation of the sheet handling device 128 is typically resumed by the controller 146.

Figure 6:
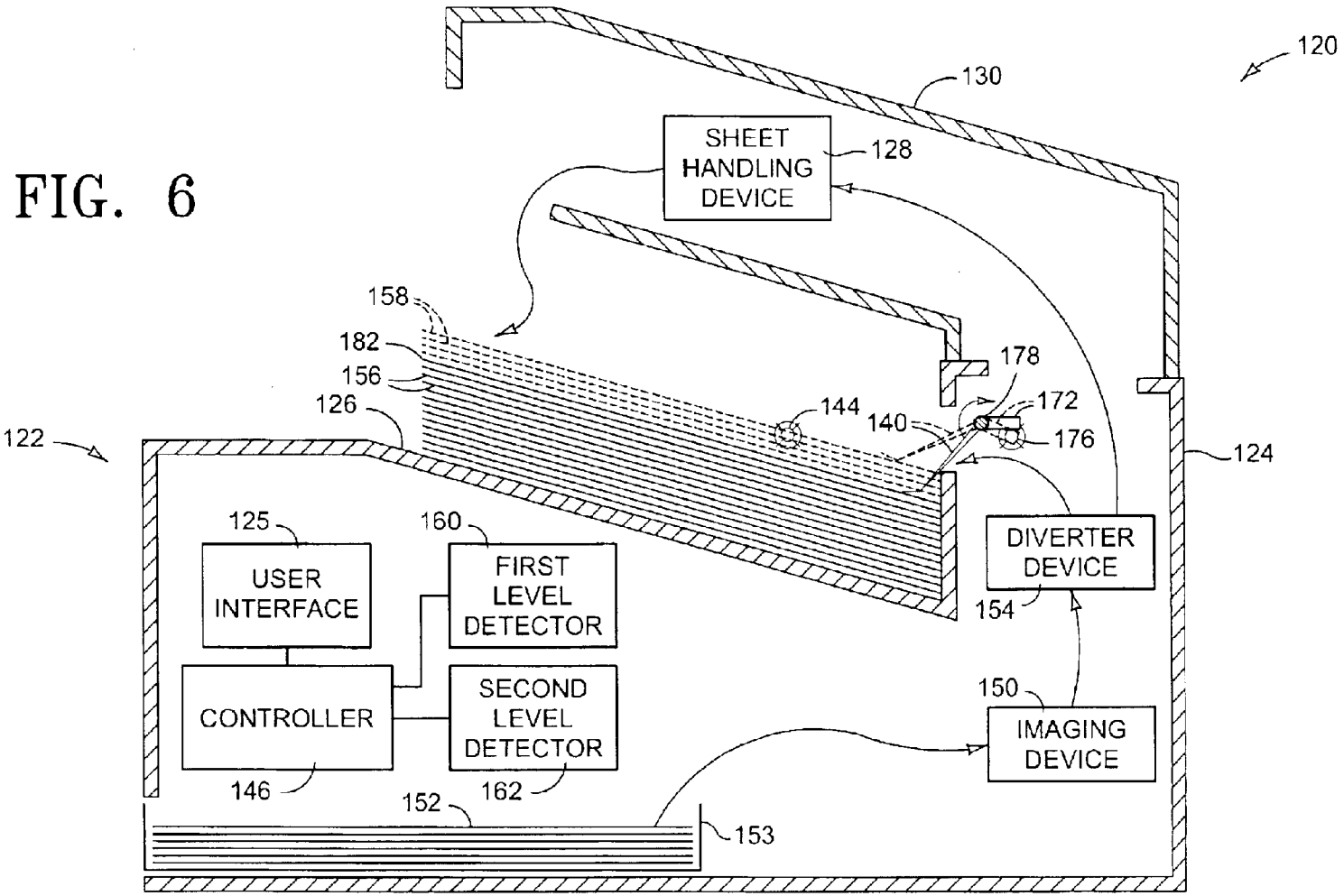
FIG. 6 is a side elevation schematic diagram depicting selected elements in accordance with the embodiment of FIG. 3.

FIG. 6 is a side elevation schematic diagram depicting a typical arrangement of selected elements (described above) of the unitary imaging apparatus 120. FIG. 6 is included to further clarify the typical arrangement and operation of the present invention as embodied by the unitary imaging apparatus 120. In the scope of FIG. 6, it is to be understood that the user interface 125, the sheet handling device 128, the imaging device 150, the diverter 154, first level detector 160, and the second level detector 162 are each in signal communication with the controller 146 as required to carry out normal operation of the unitary imaging apparatus 120. Furthermore, the first light sensor 176 and the second light sensor 144 are in signal communication with the balance of the first and second level detectors 160 and 162, respectively.

As shown in FIG. 6, the printer 122 of the imaging apparatus 120 generally underlies and supports the sheet handler housing 130, which includes the sheet handling device 128 therein. The feeler lever 140 with associated flag element 172, the first light sensor 176, and the second light sensor 144 are shown as typically mutually disposed, so as to define and detect the respectively associated predetermined "full" levels of the printed sheet media 156 and the handled sheet media 158 within the output tray 126.

It is noted in FIG. 6 that the handled sheet media 158 generally rests on top of the feeler lever 140, after arriving in the output tray 126 from the sheet handler 128. As described above, this results in a general inability of the first level detector 160 to detect a "full" condition of the handled sheet media 158 within the output tray 126. Thus, the second level detector 162 is included to detect the predetermined "full" condition of the handled sheet media 158 within the output tray 126 of the unitary imaging apparatus 120.

Within the context of FIGS. 3 through 6, it will be appreciated that the first light source 174 and the first light sensor 176, and the second light source 142 and the second light sensor 144, generally constitute respective first and second level detectors, and that other types of level detectors can be used. For example, the feeler 140 can be configured to open or close a switch (in signal communication with the controller 146 of FIG. 4) when the first predetermined level is reached, thus disabling operation of the imaging device 150 or notifying a user of the "bin full" condition by way of the user interface 125 (FIG. 3). In this example, the switch serves as the first level detector, replacing the first light source 174 and the first light sensor 176.

In another example, the second light source 142 and the second light sensor 144 can be replaced with a spring-loaded actuator (not shown) placed in the output tray 126, such that when a predetermined mass of sheet media 156 in the output tray accumulates, the actuator will open or close a switch. In this latter example, the switch can be placed in signal communication with the controller (146 of FIG. 4) such that when the second predetermined level is reached, the operation of the handing device 128 (and/or the imaging device 150) can be disabled, and/or the user notified of the "bin full" condition by way of the user interface 125 (FIG. 3). In general, the first and second level detectors (160, 162, FIG. 4) are configured to generally detect a predetermined "bin-full" condition in the output tray 126, and to provide a signal indication of such condition to the controller 146.

Therefore, an improved unitary imaging apparatus is provided by the present invention. The unitary imaging apparatus of the present invention can be generically described as including a number of sheet media level detectors corresponding to a number of different sources that discharge sheet media into a common output tray. Each level detector is configured to provide a signal in response to a predetermined or "full" level of the associated sheet media within the common output tray. Furthermore, the invention provides that a controller can make use of the respective level signals to selectively suspend various operations of the imaging apparatus, alert a user to a full output tray condition, or to initiate and/or suspend other functions as desired.

The controller 146 of FIG. 4 can include a processor (such as a microprocessor), or it can be configured solely from state circuit devices, or it can be a combination thereof. When the controller includes a processor, then the computer readable memory device 148 can contain a set of computer executable instructions to perform the acts described above with respect to disabling the imaging device 150 and/or the sheet handling device 128, and notifying a user via the user interface 125. One example of a logic program that can be provided within the controller 146 is depicted in the flowchart 200 of FIG. 7.

Figure 7:
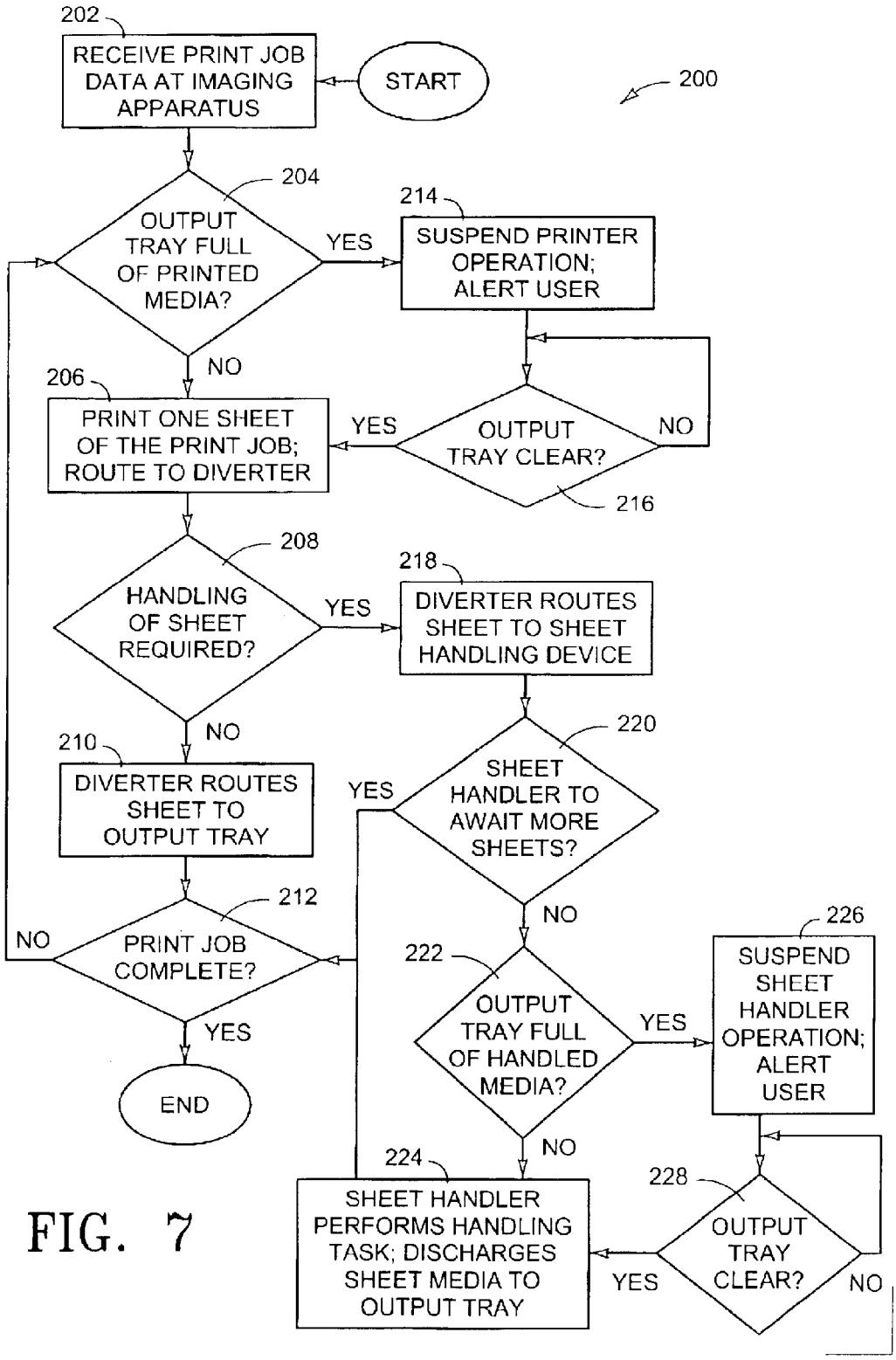
FIG. 7 is a flowchart depicting an operating method in accordance with the embodiment of FIG. 3.

FIG. 7 is a flowchart depicting an operating method (i.e., logic) 200 in accordance with the embodiment of FIG. 3, beginning with step 202.

In step 202, the controller 146 of the unitary imaging apparatus 120 receives print job data from a computer or other source in signal communication therewith. The print job data typically defines a document or documents to be printed (i.e., image formed) onto sheet media, and optionally handled.

In step 204, the controller 146 determines if the output tray 126 is "full" of printed sheet media 156, via a signal from the first level detector 160. If not, then the sequence 200 proceeds to step 206. If so, then the sequence 200 proceeds to step 214.

In step 206, the imaging device 150 prints one sheet of the defined print job and routes it to the diverter 154, under the control of the controller 146.

In step 208, the controller 146 determines if the sheet just printed in step 206 requires handling (e.g., stapling, hole punching, etc.) as defined by the print job data. If not, then the sequence 200 proceeds to step 210. If handling is required, then the sequence 200 proceeds to step 218.

In step 210, the controller 146 instructs the diverter 154 to route and discharge the sheet printed in step 206 to the output tray 126.

In step 212, the controller 146 determines if the print job is yet complete as defined by the print job data. If not, then the sequence 200 proceeds back to the step 204 to continue processing (i.e., printing and optionally handling) the pending print job. If the print job is complete, then the sequence 200 ends.

In step 214, the controller 146 suspends normal operation of the imaging device 150, and optionally alerts a user to the "full" tray condition via the user interface 125 and/or other means, such as, for example, an e-mail message.

In step 216, the controller 146 assumes a wait-loop condition, until the "full" output tray condition last detected in step 204 is cleared. This clearing is typically accomplished by removal of the printed sheet media 156 from the output tray 126 and/or the receiving of a "resume" instruction via the user interface 125. Once the "full" condition has been cleared and/or reset, the sequence 200 proceeds to step 206.

In step 218, the diverter 154 routes the sheet printed in the last iteration of step 206 onto the sheet handling device 128, as instructed by the controller 146.

In step 220, the controller 146 determines if additional printed sheets must be sent to the sheet handling device 128 prior to performing one or more handling operations thereon, as defined by the print job data. If not, then the sequence 200 proceeds to step 222. If the handling device 128 must wait for more sheets, then the sequence 200 returns to the step 204 via the step 212. It is assumed that under this latter condition that the print job is, by definition, not yet complete.

In step 222, the controller 146 determines if the output tray 126 is "full" of handled sheet media 158, via a signal from the second level detector 162. If not, then the sequence proceeds to step 224. If the tray is "full" of handled media 158, then the sequence 200 proceeds to step 226.

In step 224, the controller 146 causes the sheet handling device 128 to perform one or more handling operations on the printed sheet media 156, as defined by the print job data. The sheet handling device can use or more of the elements 164–170 previously described in performing the sheet handling operation(s). The sheet handling device 128 then discharges the handled sheet media 158 into the output tray 126. The sequence 200 then proceeds to step 212.

In step 226, the controller 146 suspends normal operation of the sheet handling device 128, and optionally alerts a user to the "full" tray condition via the user interface 125 and/or other means (for example, e-mail).

In step 228, the controller 146 assumes a wait-loop condition until such time that the "full" condition of the output tray 126 detected in the last iteration of step 222 is cleared. Such clearing typically occurs by removal of the handled sheet media 158 from the output tray 126 and/or the receiving of a "resume" instruction via the user interface 125. After the "full" condition is cleared, the sequence 200 proceeds to the step 224.

As just described, FIG. 7 outlines one possible logic sequence (method) for carrying out the present invention. Other methods can also be used, which employ a plurality of sheet media level detectors in conjunction with a single receiving tray, so as to realize a unitary imaging apparatus that imposes a reduced reach burden upon the user as compared to the prior art.

While the above methods and apparatus have been described in language more or less specific as to structural and methodical features, it is to be understood, however, that they are not limited to the specific features shown and described, since the means herein disclosed comprise preferred forms of putting the invention into effect. The methods and apparatus are, therefore, claimed in any of their forms or modifications within the proper scope of the appended claims appropriately interpreted in accordance with the doctrine of equivalents.

We claim:

1. A sheet media level detection system, comprising:

a first level detector configured to provide a first signal corresponding to a first predetermined level of a first sheet media from a first source within an output tray; and a second level detector configured to provide a second signal corresponding to a second predetermined level of a second sheet media from a second source within the output tray.

2. The sheet media level detection system of claim 1, and wherein the first predetermined level is substantially equal to the second predetermined level.

3. The sheet media level detection system of claim 1, and wherein the first source is an imaging device and the second source is a sheet handling device, and wherein the imaging device is optionally defined by a printer, and wherein the sheet handling device includes at least one of a stapler, a collator, a folder, or a hole punch.

4. The sheet media level detection system of claim 1, and wherein the first level detector is coupled to the first source such that the first signal selectively suspends normal operation of the first source.

5. The sheet media level detection system of claim 1, and wherein the second level detector is coupled to the second source such that the second signal selectively suspends normal operation of the second source.

6. The sheet media level detection system of claim 1, and wherein the first level detector includes a light source and a light sensor and a feeler lever configured such that the feeler lever substantially blocks a beam of light from the light source to the light sensor during the detecting the first predetermined level of the first sheet media.

7. The sheet media level detection system of claim 1, and wherein the second level detector includes a light source and a light sensor configured such that the second sheet media substantially blocks a beam of light from the light source to the light sensor during the detecting the second predetermined level of the second sheet media.

8. A sheet media level detection system configured for use in conjunction with an imaging device and a sheet handling device common to a unitary imaging apparatus, comprising:

a first level detector configured to provide a first signal to the imaging device in response to detecting a first predetermined level of a first sheet media in an output tray, the first sheet media having passed through the imaging device prior to arriving in the output tray; and a second level detector configured to provide a second signal to the sheet handling device In response to detecting a second predetermined level of a second sheet media in the output tray, the second sheet media having passed through the sheet handling device prior to arriving in the output tray.

9. The sheet media level detection system of claim 8, and wherein the first signal provided by the first level detector can be used by the imaging device to resumably suspend normal operation thereof, and wherein the second signal provided by the second level detector can be used by the sheet handling device to resumably suspend normal operation thereof.

10. The sheet media level detection system of claim 8, and wherein the first level detector includes a light source and light sensor and a feeler lever configured such that the first level detector provides the first signal to the imaging device in response to the feeler lever substantially blocking a beam of light from the light source to the light sensor during the detection of the first predetermined level of the first sheet media.

11. The sheet media level detection system of claim 8, and wherein the second level detector includes a light source and a light sensor configured such that the second level detector provides the second signal to the sheet handling device in response to the second sheet media substantially blocking a beam of light from the light source to the light sensor during the detection of the second predetermined level of the second sheet media.

12. An imaging apparatus, comprising:

an imaging device configured to generate an image on sheet media;

a sheet handling device configured to receive sheet media from the imaging device;

an output tray configured to receive sheet media from both of the imaging device and the sheet handling device; and a sheet media level detection system, comprising:

a first level detector configured to provide a first signal to the imaging device in correspondence to a first predetermined level of sheet media placed in the output tray by the imaging device; and a second level detector configured to provide a second signal to the sheet handling device in correspondence to a second predetermined level of sheet media placed in the output tray by the sheet handling device.

13. The imaging apparatus of claim 12, and wherein the sheet handling device includes at least one of a stapler, a collator, a folder, or a hole punch.

14. The imaging apparatus of claim 12, and wherein the imaging device is further configured to resumably suspend normal operation in response to the first signal provided by the first level detector, and wherein the sheet handling device is further configured to resumably suspend normal operation in response to the second signal provided by the second level detector.

15. The imaging apparatus of claim 14, and further comprising a control panel configured to respectively indicate the suspended normal operation of the imaging device and the sheet handling device, and wherein the control panel is further configured to receive respective commands that cause the imaging device and the sheet handling device to resume normal operation.

16. The imaging apparatus of claim 12, and further comprising a processor coupled to the first and the second signals and configured to selectively control and suspend and resume normal operation of the imaging device and the sheet handling device, respectively.

17. The imaging apparatus of claim 12, and wherein the first level detector includes a light source and light sensor and a feeler lever configured such that the feeler lever substantially blocks a beam of light from the light source to the light sensor during the detecting the first predetermined level of the sheet media from the imaging device.

18. The imaging apparatus of claim 12, and wherein the second level detector includes a light source and a light sensor configured such that the sheet media from the sheet handling device substantially blocks a beam of light from the light source to the light sensor during the detecting the second predetermined level of the sheet media from the sheet handling device.

19. A printer device, comprising:

means for forming images on a first and a second sheet media;

means for receiving the first and second sheet media;

means for selectively performing at least one sheet handling operation on the second sheet media and then discharging the second sheet media to the receiving means;

means for selectively diverting the first sheet media from the image forming means to the receiving means and the second sheet media from the image forming means to the sheet handling means;

means for providing a first signal in correspondence to a first predetermined level of the first sheet media in the receiving means; and means for providing a second signal in correspondence to a second predetermined level of the second sheet media in the receiving means.

20. The printer device of claim 19, and further comprising means for coupling the first signal to the image forming means such that the image forming means selectively suspends normal operation in response to the first signal.

21. The printer device of claim 19, and further comprising means for coupling the second signal to the sheet handling means such that the sheet handling means selectively suspends normal operation in response to the second signal.

22. A method of detecting respective predetermined levels of a first sheet media and a second sheet media within a common output tray, comprising:

routing the first sheet media from an imaging device into the output tray using a diverter device;

routing the second sheet media from the imaging device into a sheet handling device and then into the output tray using the diverter device;

issuing a first signal in response to detecting a first predetermined level of the first sheet media in the output tray using a first level detector; and issuing a second signal in response to detecting a second predetermined level of the second sheet media in the output tray using a second level detector.

23. The method of claim 22, and further comprising selectively suspending normal operation of the imaging device in response to the issuing the first signal using circuitry coupled to the first level detector and the imaging device.

24. The method of claim 22, and further comprising selectively suspending normal operation of the sheet handling device in response to the issuing the second signal using circuitry coupled to the second level detector and the sheet handling device.

* * * * *